US005411306A

United States Patent [19]

Campbell et al.

[11] Patent Number: 5,411,306

[45] Date of Patent: May 2, 1995

[54] METHOD AND DEVICE FOR INVERTING A TURBINE CYLINDER COVER

[75] Inventors: Ira J. Campbell, East Bradford, Pa.; Cletus L. Schartner, St. Petersburg, Fla.; David A. Daugherty, Upper Chichester; Walter B. Vogel, Brookhaven, both of Pa.; Lawrence J. Coyle, Wilmington, Del.

[73] Assignee: Westinghouse Electric Corporation, Pittsburgh, Pa.

[21] Appl. No.: 110,033

[22] Filed: Aug. 20, 1993

[51] Int. Cl.[6] ..... B66C 1/16; B66C 13/08

[52] U.S. Cl. ..... 294/81.4; 294/67.5; 294/81.5

[58] Field of Search ..... 294/67.1, 67.3, 67.4, 294/67.5, 68.26, 68.27, 74, 81.1–81.5, 81.55, 81.56, 81.6, 81.62, 82.12, 86.41, 119.2; 414/756, 758, 783

[56] References Cited

U.S. PATENT DOCUMENTS

| | | | |
|---|---|---|---|
| 1,516,973 | 11/1924 | Loughran | 294/81.62 |
| 1,794,714 | 3/1931 | Kiplinger | 294/68.27 X |
| 2,076,758 | 4/1937 | Whiting | 294/119.2 X |
| 2,860,002 | 11/1958 | Herbst | 294/81.5 X |
| 3,047,916 | 8/1962 | O'Brien | 294/68.26 |
| 3,127,645 | 4/1964 | Dyck | 294/68.27 |
| 3,314,550 | 4/1967 | McCready et al. | 294/68.27 X |
| 3,425,738 | 2/1969 | Feldman et al. | 294/74 |
| 3,797,877 | 3/1974 | Soehrens | 294/67.1 |

FOREIGN PATENT DOCUMENTS

| | | | |
|---|---|---|---|
| 3830849 | 3/1990 | Germany | 294/67.5 |
| 1004243 | 3/1983 | U.S.S.R. | 294/81.4 |
| 1133216 | 1/1985 | U.S.S.R. | 294/67.5 |
| 1562287 | 5/1990 | U.S.S.R. | 294/67.5 |
| 1682292 | 10/1991 | U.S.S.R. | 294/67.5 |

*Primary Examiner*—Johnny D. Cherry

[57] ABSTRACT

The invention in its broadest form includes a device for inverting a cover with a predetermined weight from a horizontal position to an inverted position, the device comprising a crane for lifting the cover; at least two pivotable brackets each attached to both the cover and the crane and positioned to suspend a substantial amount of the weight of the cover for pivoting the cover; and a cable attached to the cover at one end and to the crane at its other end and positioned to suspend a nominal amount of the weight of the cover for supporting the cover.

11 Claims, 6 Drawing Sheets

METHOD AND DEVICE FOR INVERTING A TURBINE CYLINDER COVER

BACKGROUND OF THE INVENTION

1. Field of the Invention

The present invention relates to turbine cylinder covers and, more particularly, is concerned with a method and device for inverting turbine cylinder covers.

2. Description of the Prior Art

A high pressure turbine includes a cylindrical body formed from a cylinder cover and a bottom. The bottom forms the foundation for the turbine, and the cylinder cover is bolted atop the cylinder cover for forming a sealed enclosure. Attachment devices, such as eyelets, are positioned on the cover for lifting purposes. Two steam inlets are disposed atop the cover for allowing steam to enter the body, and four steam outlets are disposed on the bottom for allowing steam to exit the body. Pipes are attached to both inlets and outlets for passing the steam therethrough. A turbine shaft is positioned longitudinally inside the turbine body and includes turbine blades attached circumferentially around the shaft. When operational, the steam enters the steam inlets, turns the turbine blades, and then exits the body via the outlets as is well known in the art.

To invert the cylinder cover for inspection, the bolts are removed, and the cylinder cover is detached from the bottom and placed on a floor by means well known in the art. A crane, which includes two hooks, is positioned adjacent the generator for inverting the cylinder cover. In power plants, where most turbine generators are located, the crane typically includes a large hook and a small hook for lifting the cover. As is well known in the art, present devices and methods require two hooks to invert the cover. The small hook, however, is insufficient for cylinder cover inversion because the attachment devices of the cylinder cover are positioned so that the small hook must support a weight heavier than its capacity. To overcome this deficiency, a portable crane with an adequate hook should be temporarily used to supplement the large hook of the existing crane. The cover may then be lifted and inverted.

Although the present device and method are satisfactory, it is not without drawbacks. Installing such a temporary crane is costly and time consuming because it requires acquiring and installing this temporary crane.

Consequently, a need exists for an improved device and method for lifting a turbine cover.

SUMMARY OF THE INVENTION

The present invention provides an improvement designed to satisfy the aforementioned needs. Particularly, the present invention is directed to a device for inverting a turbine cylinder cover having a predetermined weight from an upright position to an inverted position, the device comprising: a) a lifting means for lifting the cover; b) at least two pivotable brackets each attached to both the cover and said lifting means for suspending a majority of the weight of the turbine cylinder cover and for pivoting the turbine cylinder cover; and c) a cable adapted to be interchangeably attached between a first and second position to the turbine cylinder cover at one end and attached to said lifting means at its other end for suspending a nominal weight of the cover for supporting the turbine cover.

Further, in accordance with the present invention, there is provided a method for inverting a turbine cylinder cover having a predetermined weight from an upright position to an inverted position, the method comprising the steps of: a) positioning a lifting means in position for lifting the cover; b) attaching at least two pivotable brackets each to both the cover and the lifting means for pivoting the cover and for suspending a majority of the weight of cover; and c) attaching a cable to both the lifting means and the cover for suspending a nominal amount of the weight of the cover; and d) inverting the cover by cooperation of the brackets, cable, and lifting means.

BRIEF DESCRIPTION OF THE DRAWINGS

In the course of the following detailed description, reference will be made to the attached drawings in which.

DETAILED DESCRIPTION OF THE INVENTION

Figure 1:
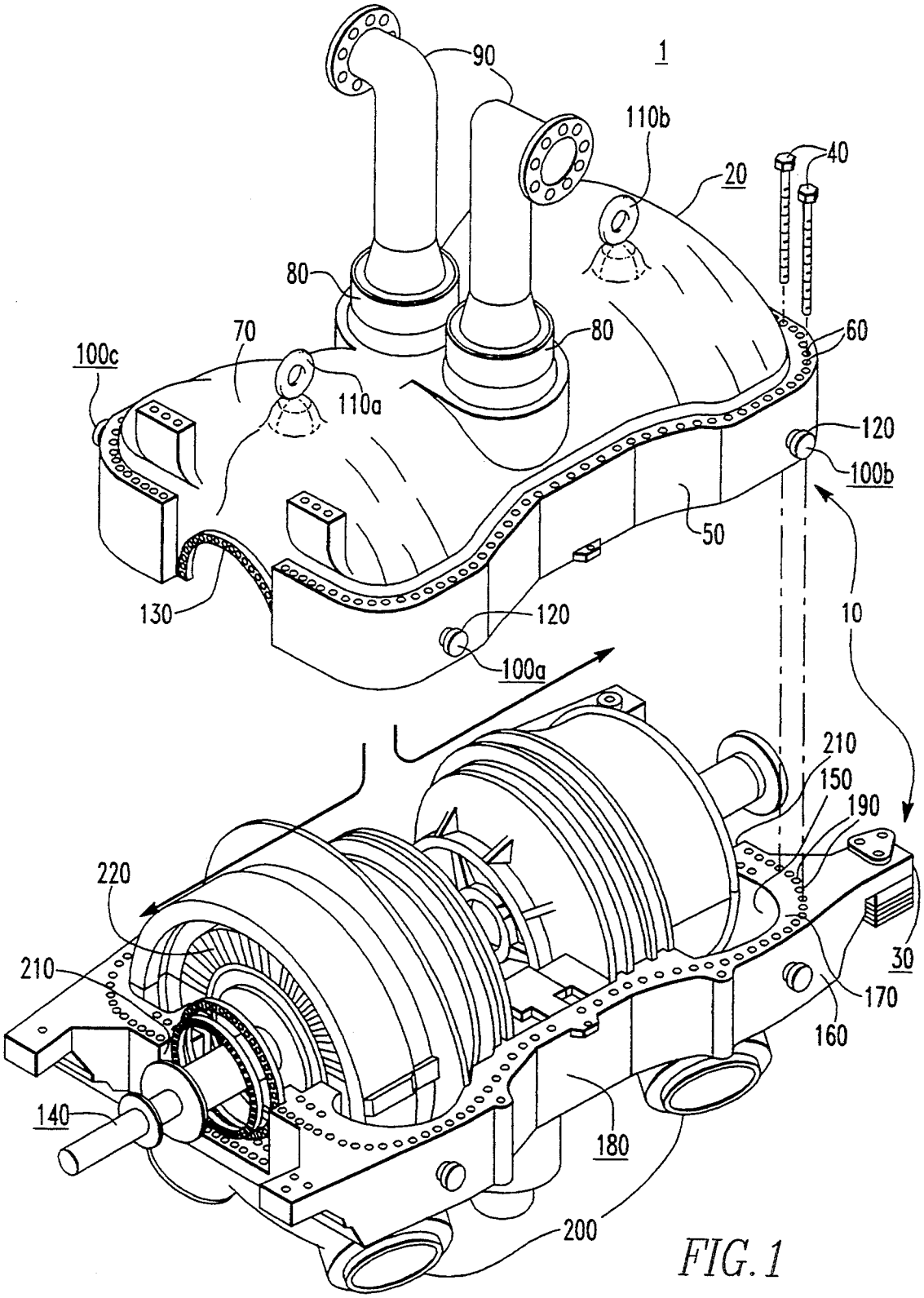
FIG. 1 illustrates a perspective view of a high pressure turbine.

In the following description, like reference characters designate like or corresponding parts throughout the several views of the drawings. Also in the following description, it is to be understood that such terms as "forward," "left," "right," "upwardly," "downwardly," and the like are words of convenience and are not to be construed as limiting.

Referring now to the drawings, and particularly to FIG. 1, there is illustrated a high pressure turbine as is well known in the art, generally referred to as 1. The turbine includes an outer cylinder 10 formed from a cylinder cover 20, typically weighing approximately 84 tons, attached atop a cylinder bottom 30 by a plurality of bolts 40. The outer cylinder 10 protects the components disposed therein and contains the internal steam pressure. An outwardly extending flange 50 extends around the periphery of the cover 20 wherein a plurality of holes 60 extend therethrough for receiving the plurality of bolts 40. The cover 20 includes an outer surface 70 and an inner surface (not shown) defining a wall thickness (not shown) therebetween. Two steam inlets 80 are positioned atop the cover 20 with a cylindrical steam inlet pipe 90 attached to each inlet 80. The inlets 80 and the pipes 90 function together to pass steam into the turbine. Four circular knobs 100*a*, 100*b*, and 100*c* (only three are shown in FIG. 1) are respectively attached on the flange 50 adjacent a corner of the cover 20, and two eyelets 110*a* and 110*b* are attached on a top portion of the cover 20 upwardly from the knobs 100*a* and 100*b*. Both the knobs 100*a* and 100*b* and eyelets 110*a* and 110*b* function as attachment devices for lifting the cover 20 as will be described later in detail. Each knob 100*a* and 100*b* includes an enlarged lip portion 120 at its end portion for preventing any lifting attachment from slipping therefrom. An arcuate notch 130 (only one shown in FIG. 1) is positioned at each end of the cover 20 for receiving a portion of a turbine shaft 140 as is well known in the art.

The outer cylinder bottom 30 includes an inner surface 150 and an outer surface 160 defining a wall thickness 170 therebetween. An outwardly extending flange 180 extends around the periphery of the bottom 30 wherein a plurality of holes 190 extend therethrough. The bottom holes 190 and the cover holes 60 are positioned in registry with each other and, when so aligned, both receive the plurality of bolts 40 for attaching the cylinder cover 20 to the cylinder bottom 30. Four steam outlets 200 (only two are shown in FIG. 1) are attached to the cylinder bottom 30 for passing the steam out of the bottom 30. Two arcuate notches 210 are respectively in alignment with the notches 130 in the cover 30 for receiving a portion of the turbine shaft 140 as is well known in the art.

The turbine shaft 140 extends longitudinally along the turbine 1 and includes turbine blades 220 positioned circumferentially around the shaft 140. When operational, the steam enters both the steam inlets 80 on the cover 20 and then passes bi-directionally along the longitudinal length of the shaft 140 as indicated by the arrows. The steam turns the turbine blades 220 which, in turn, turn a generator (not shown) for producing electricity, as is well known in the art. The steam then exits the turbine 1 via the steam outlets 220 and passes to a low pressure turbine (not shown) as is well known in the art.

Figure 2:
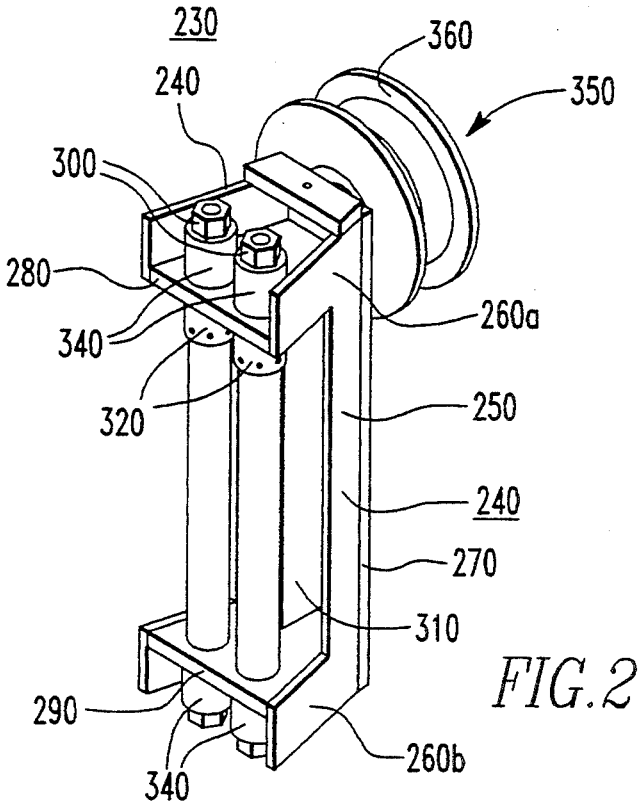
FIG. 2 illustrates a perspective view of a bracket of the present invention.
Figure 3:
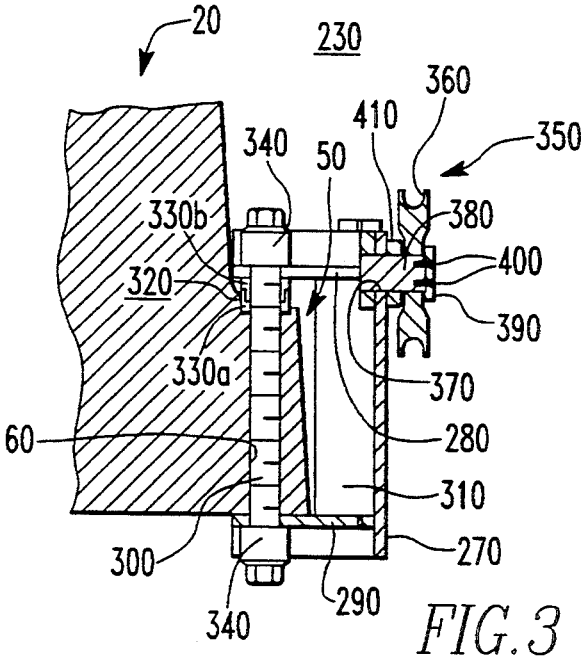
FIG. 3 illustrates a side view in vertical cross section of the bracket attached to the high pressure turbine.

Referring to FIG. 2, a bracket 230 of the present invention is shown for attachment to and lifting the turbine cylinder cover 20 (see FIG. 1). The bracket 230 includes two generally U-shaped support members 240 disposed spaced apart from each other. Each U-shaped support member 240 includes a rectangular shaped middle portion 250 with two rectangular shaped end portions **260*a* and 260*b* extending outwardly and respectively from each end of the middle portion 250. A rectangular shaped vertical member 270 is attached longitudinally to both support members 240 for connecting the two support members 240 together. A top platform portion 280 and a bottom platform portion 290 connect the opposing end portions 260*a* and 260*b* together, and a pair of holes (not shown) extend through each platform portion 280 and 290 each for receiving a pair of bolts 300. The holes in the top platform portion 280 are positioned in registry with the holes in the bottom platform portion 290 for allowing the bolts 300 to pass therethrough. A rectangular shaped column 310 extends between the top 280 and bottom platform portions 290 for strengthening the bracket 230. A spacer nut 320 is disposed at one end of each bolt 300 for adjusting to different size flanges 50 (see FIG. 1). Referring to FIG. 3, the spacer nut 320 includes two circular, threaded members 330*a* and 330*b* threadedly attached together, and the circular members 330*a* and 330*b* are either unthreaded or threaded to adjust the spacer 320 to different heights. A nut 340 is threaded onto the top and bottom portion of each bolt 300 for bolting the bracket 230 to the flange 50**.

A circular pulley device 350 with a circumferentially extending groove 360 therein is attached to the vertical member 270 for receiving a cable (not shown in FIG. 2). A bore 370 extends through the vertical member 270 and into the top platform portion 280 for receiving an axle 380. The axle 380 attaches the pulley device 350 to the vertical member 270. A cap 390 secures the axle 380 to the pulley device 350 via two pins 400 inserted into the axle 380. A spacer 410 is inserted between the pulley device 350 and the vertical member 270 for maintaining the pulley device 350 outwardly from the bracket 230 as will be appreciated better from the following paragraphs. The brackets 230 are positioned on the cover 20 by inserting the bolts 300 through adjacent holes 60 on the flange 50. The bolts 300 are tightened until both the top 280 and bottom platform 290 portions abut the flange 50.

Figure 4:
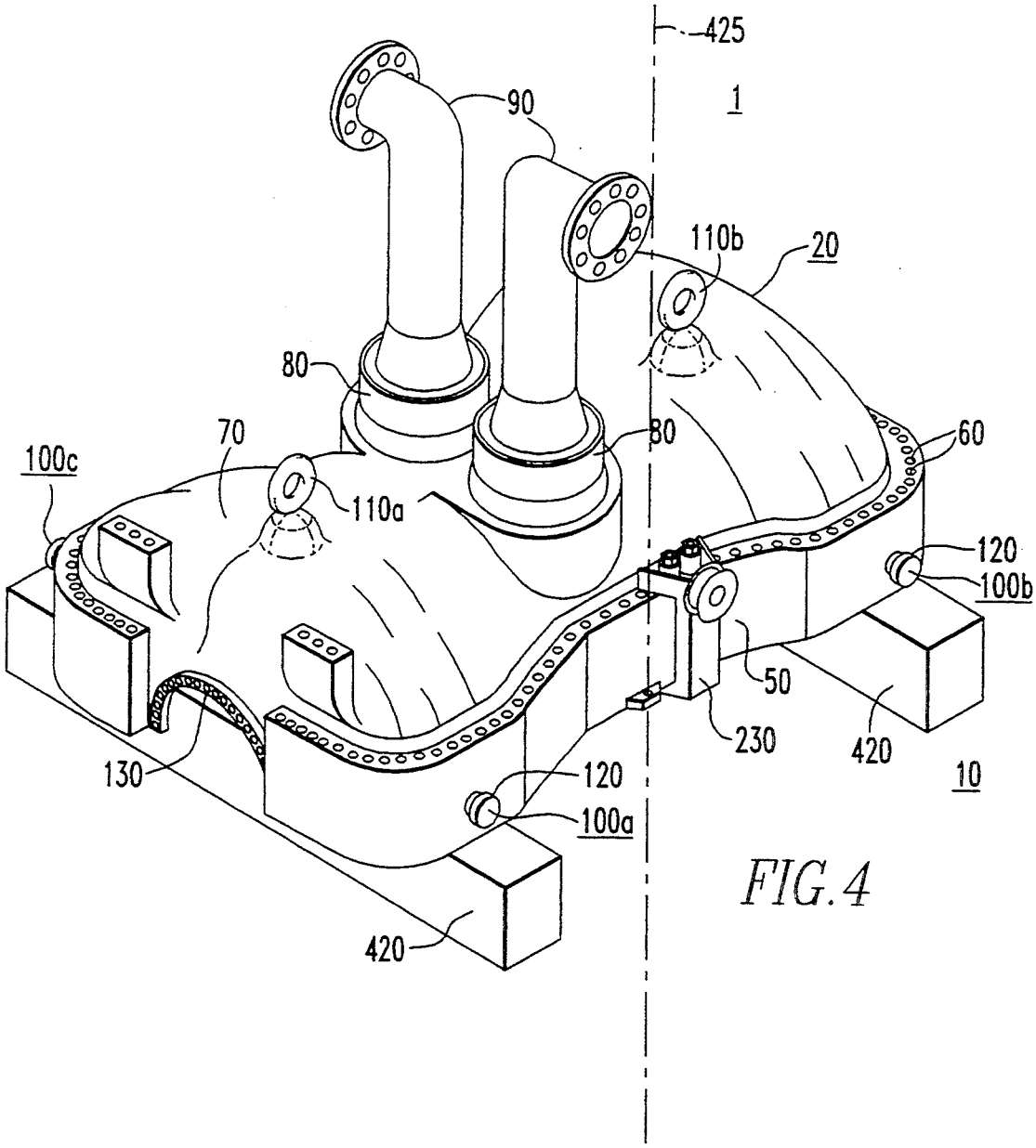
FIG. 4 illustrates a turbine cylinder cover of the high pressure turbine resting on blocks.

Referring to FIG. 4, the cylinder cover 20 is unbolted and placed on blocks 420 in a horizontal position by conventional methods and means as is well known in the art. The blocks 420 are disposed atop a floor (not shown) or the like. The cylinder cover 20 is placed on blocks 420 so that the brackets 230 may be placed on the flange, as described herein below. The brackets 230 (only one shown in FIG. 4) are each positioned equidistantly, approximately 16 inches from the centerline 425, on opposite portions of the flange 50 so that each bracket 230 carries an equal weight. The position of the bracket 230 ensures that the weight of the cylinder cover 20 is proportioned correctly as will described later in detail.

Figure 5:
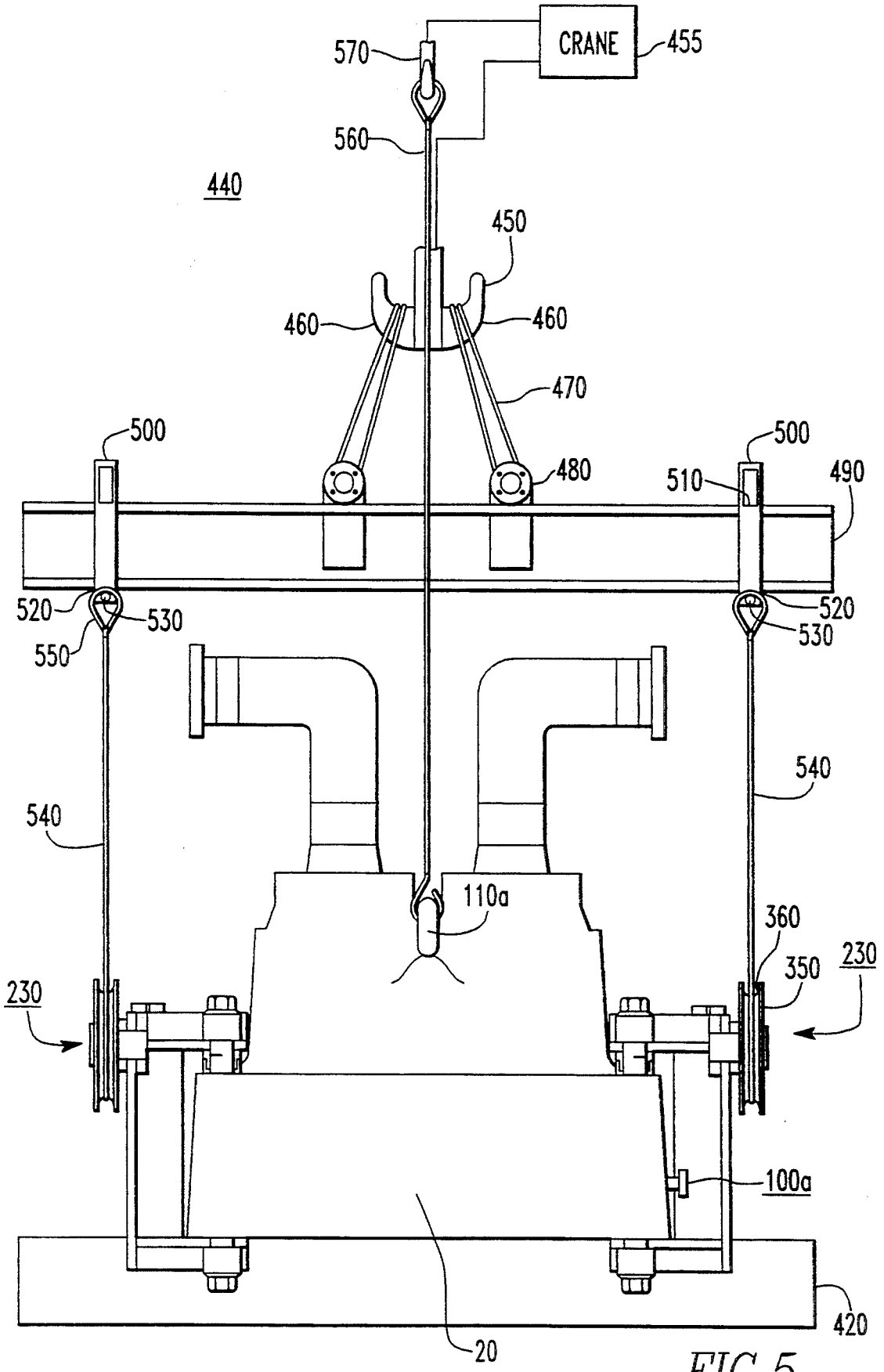
FIG. 5 illustrates a rear elevation view of a lifting device of the present invention.
Figure 6:
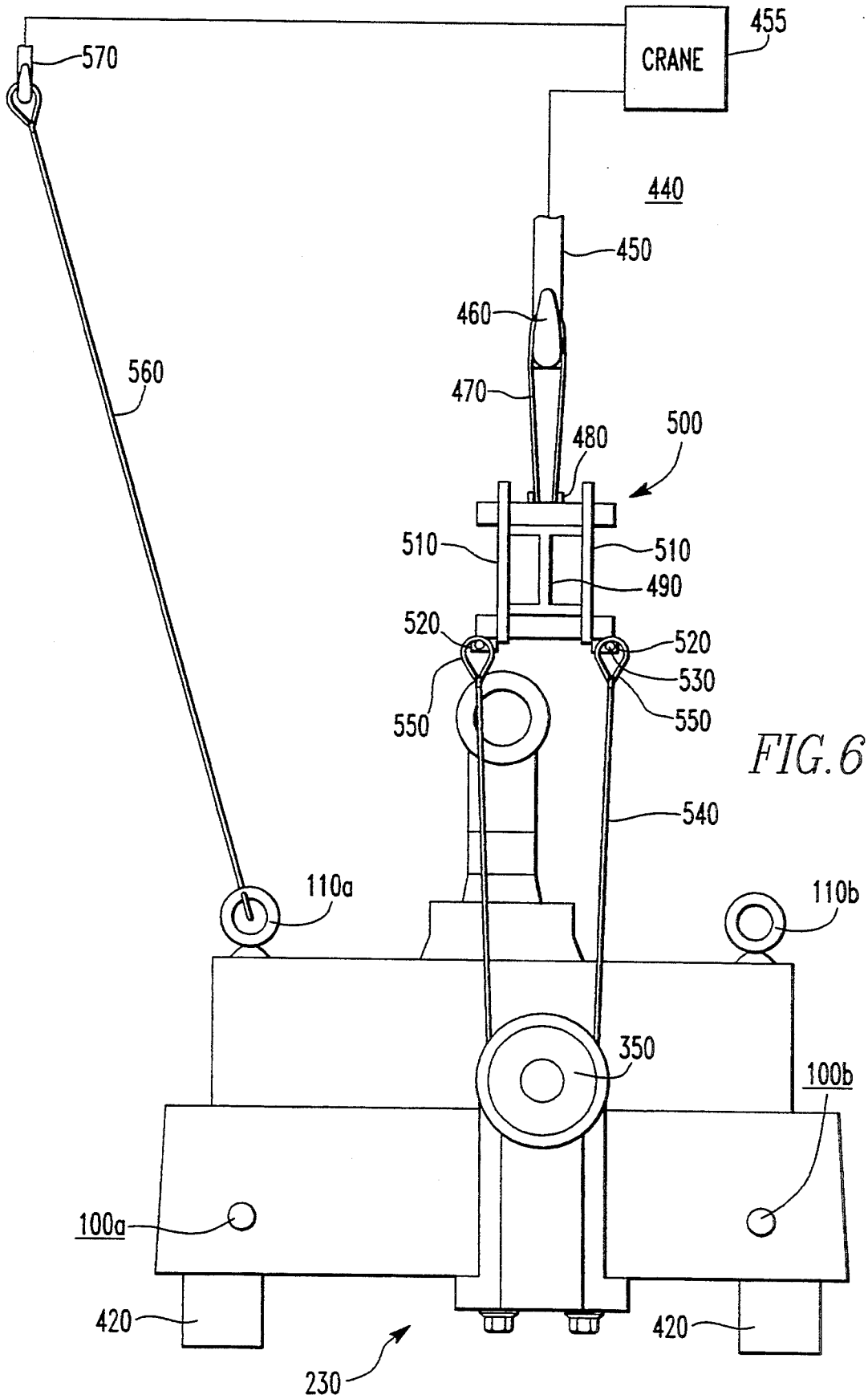
FIG. 6 illustrates a side elevation view of the lifting device of the present invention.

Referring to FIGS. 5 and 6, an inverting device 440 of the present invention for inverting the cylinder cover 20 is illustrated. A primary hook 450 of a crane 455 includes two hooked shaped portions 460 for attaching a cable 470 to each hooked portion 460. The primary hook 450, when used in cooperation with the brackets 230, sustains a majority of the weight (approximately 84 tons) of the cover 20. Each cable 470 is attached to each hooked portion 460 and to a corresponding attachment 480, which is welded to an I-shaped beam 490 by conventional methods. Two movable, generally rectangular shaped yokes 500 are each positioned on the beam 490 and enclosedly surrounds the beam 490. The yoke 500 includes four legs 510 attached together for enclosedly surrounding the beam 490. One leg 510 includes an outwardly extending lip portion 520 at each end for each receiving a knob 530. Each knob 530 functions to each hold a cable end of a cable 540 thereto. The cable 540 is positioned in the groove 360 of the pulley device 350 and includes an eyelet 550 at each end for attachment to each knob 530.

A cable 560 with two ends is attached to a secondary hook 570 of the crane 455 at one end and to either eyelet **110*a* or 110*b* at its other end. The secondary hook 570 is positioned such as to sustain a nominal amount of the weight (approximately 15 tons of the total weight of the cover) when lifting the cover 20. The secondary hook 570, to sustain its proper weight, is positioned on the periphery of the cover 20 (i.e., cover eyelets 110*a*) so that the primary hook 450** sustains the majority of the weight.

With the cylinder cover 20 in a horizontal position, the primary hook 450 in cooperation with the brackets 230 is attached to the cylinder cover 20 as explained above, and the secondary hook 570 is attached to eyelet **110*a* in this embodiment, although either eyelet 110*a* or 110*b* may be used. The crane then lifts the cover 20 upwardly off the blocks 420**.

Figure 6A:
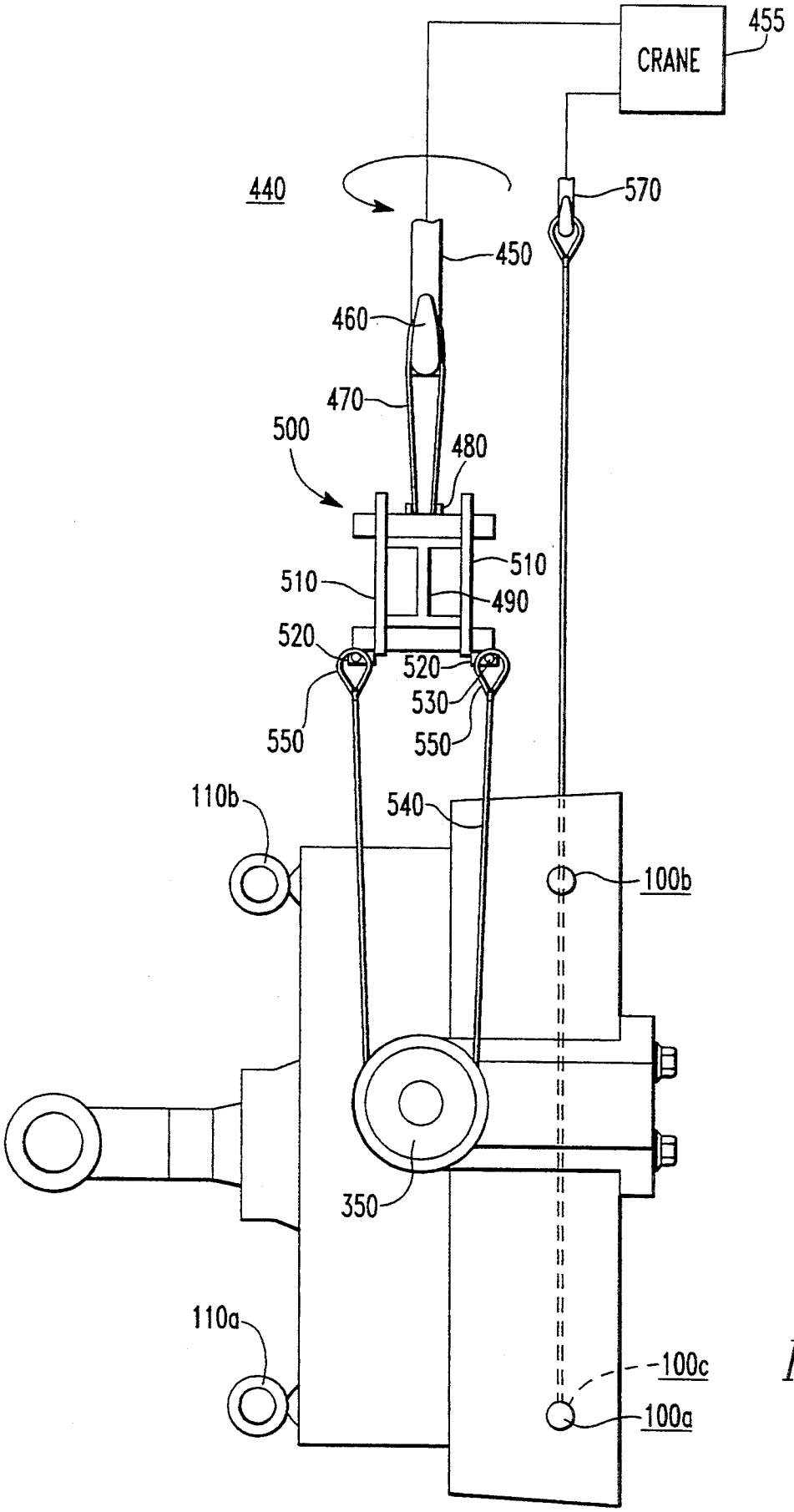

Referring to FIG. 6A, the secondary hook 570 is lowered until the cover 20 is substantially ninety degrees from the horizontal position. With the cylinder cover 20 in this ninety degree position, the cylinder cover 20 is entirely suspended by the brackets 230. The secondary hook 570 is then removed from the eyelet **110*a*. The cover 20 is manually rotated by operators generally one hundred eighty degrees along the longitudinal axis of the cover 20 as indicated by the arrows. As is well known in the art, the crane 455 allows such rotation. After this one hundred eighty degree rotation, the secondary hook 570 is attached to the eyelet 100***c* as indicated in phantom. The secondary cable 560 is then raised until the cylinder cover 20 is in the inverted position.

To re-position the cover 20 in the horizontal position, the above described steps are repeated in reverse order.

It is thought that the present invention and many of its attendant advantages will be understood from the foregoing description and it will be apparent that various changes may be made in the form, construction and arrangement thereof without departing from the spirit and scope of the invention or sacrificing all of its material advantages, the form hereinbefore described being merely a preferred or exemplary embodiment.

We claim:

1. A device for inverting a turbine cylinder cover with a predetermined weight from a horizontal position to an inverted position, the device comprising:

a) a lifting means for lifting the turbine cylinder cover;

b) at least two pivotable brackets each attached to both the turbine cylinder cover and said lifting means for suspending a majority of the weight of the turbine cylinder cover and for pivoting the turbine cover; and c) a cable attached at its first end to a first position on the cylinder cover and at its second end to said lifting means during a first portion of the inversion of the cylinder cover and the first end attached to a second position on the cylinder cover during completion of the inversion of the cylinder cover for assisting in inversion of the turbine cylinder cover.

2. The device as in claim 1, wherein said brackets are each attached to the turbine cover adjacent a centerline of the cylinder cover.

3. The device as in claim 2, wherein said cable is attached to the turbine cylinder cover adjacent a top portion of the turbine cylinder cover in the first position and to a peripheral portion of the turbine cylinder cover in the second position.

4. The device as in claim 3, wherein said brackets each comprise a pulley for pivoting the turbine cylinder cover.

5. The device as in claim 4, wherein said lifting means includes a cable cooperating with each said pulley for pivoting the turbine cylinder cover.

6. The device as in claim 5, wherein said lifting means includes a hook, a beam, and two cables connected between the hook and the beam for lifting the turbine cylinder cover.

7. The device as in claim 6, wherein said brackets are adjustable for connecting to different size flanges of the turbine cylinder cover.

8. A method for inverting a turbine cylinder with a predetermined weight from a horizontal position to an inverted position, the method comprising the steps of:

a) attaching adjacent a turbine cylinder cover centerline at least two pivotable brackets each to both the turbine cylinder cover and a lifting means for pivoting the turbine cylinder cover and for suspending a substantial weight of the turbine cylinder cover;

b) attaching a cable at its first end to a first position on the cylinder cover and attaching its second end to the lifting means during a first portion of the inversion of the cylinder cover for suspending a nominal amount of the weight of the turbine cylinder cover; and c) shifting the first end of the cable to a second position on the cylinder cover for completing inversion of the cylinder cover.

9. The method of claim 8, wherein said step of (c) inverting the turbine cylinder cover by cooperation of the brackets, cable, and lifting means includes the step of partially inverting the turbine cylinder cover, rotating the turbine cylinder cover, and switching the cable to the second position for complete inversion of the turbine cylinder cover.

10. The method of claim 9, wherein said step of (b) attaching the cable to both the lifting means and the turbine cylinder cover for suspending a nominal amount of the weight of the turbine cylinder cover includes the step of pivoting the turbine cylinder cover by a pulley.

11. The method of claim 10 further comprising the step of removing the turbine cylinder cover from a turbine and placing the turbine cylinder cover in a horizontal position on a block for elevating the turbine cylinder cover upwardly from a floor, which allows the brackets to be attached to the turbine cylinder cover.

* * * * *